United States Patent [19]

Sutherland

[11] Patent Number: 4,458,873

[45] Date of Patent: Jul. 10, 1984

[54] PICTURE FRAME HANGER-CLIP

[75] Inventor: Christopher C. Sutherland, South Attleboro, Mass.

[73] Assignee: Craft, Inc., South Attleboro, Mass.

[21] Appl. No.: 461,935

[22] Filed: Jan. 24, 1983

[51] Int. Cl.[3] ..... A47G 1/24

[52] U.S. Cl. ..... 248/544; 248/496; 40/152.1; 206/499

[58] Field of Search ..... 248/466, 476, 477, 489, 248/495, 496, 359, 360, 497, 544; 40/152.1; D8/367, 373; 206/499, 477; 204/23

[56] References Cited

U.S. PATENT DOCUMENTS

| | | | |
|---|---|---|---|
| 3,411,665 | 11/1968 | Blum | 206/499 |
| 3,556,459 | 1/1971 | Summerville | 248/497 |
| 3,965,600 | 6/1976 | Paskerian | 40/152.1 |

FOREIGN PATENT DOCUMENTS

| | | | |
|---|---|---|---|
| 418152 | 10/1934 | United Kingdom | 248/489 |

*Primary Examiner*—William H. Schultz
*Assistant Examiner*—Robert A. Olson
*Attorney, Agent, or Firm*—Salter & Michaelson

[57] ABSTRACT

A hanger-clip for a picture frame, said frame of the type having an inwardly facing channel adjacent the upper periphery thereof and a substantially rigid rear panel which is received in the channel. The hanger-clip includes a hook element which has a downwardly extending rear plate portion and which is receivable on the upper edge of the panel so that the panel and the clip are receivable in the channel. A hanger element of the clip extends integrally upwardly from the lower end of the plate portion for mounting the clip on a wall hanging member. The hanger element is rearwardly bendable relative to the plate portion to adapt the clip for wall hanging member of various types.

1 Claim, 5 Drawing Figures

PICTURE FRAME HANGER-CLIP

BACKGROUND AND SUMMARY OF THE INVENTION

The instant invention relates to hangers for picture frames and the like for the mounting thereof on walls or other vertical supporting surfaces.

With the increased popularity in the use of prefabricated picture frames, a need has developed to provide an effective means for hanging such frames from walls or other vertical surfaces. Specifically, a need has developed for a picture frame hanger-clip which can be attached to a prefabricated picture frame of the type having an inwardly facing channel adjacent the upper periphery thereof and which is adjustable to provide a means for hanging the frame from wall hanging members of various types, dimensions and configurations. It is also desirable for a hanger-clip of this type to be adapted so that it can maintain a picture frame in closely spaced relation to a supporting surface when hung thereon. A hanger of this general type is disclosed in the U.S. Pat. No. 3,965,600, to Paskerian, which represents the closest prior art to the instant invention of which the applicant is aware. However, as will hereinafter be made apparent, the hanger of the instant invention represents a significant improvement over the hanger disclosed in this reference.

The hanger-clip of the instant invention is receivable in a picture frame of the type having an inwardly facing channel adjacent at least the upper periphery thereof and a substantially rigid rear panel which is receivable in the channel with the clip thereon. Accordingly, the hanger-clip can be used to suspend the frame from a wall or other substantially vertical supporting surface by mounting it on a nail or some other hanging member thereon. Frames of this type are quite popular and comprise a significant portion of the prefabricated picture frames currently available. Therefore, the hanger-clip of the instant invention has wide application and can be used with a significant portion of the ready made or prefabricated picture frames currently available.

The hanger-clip of the instant invention comprises a hook element having a downwardly extending rear plate portion and a hanger element which extends integrally upwardly from the bottom end of the plate portion for mounting the hanger-clip on a wall hanging member or the like. The hook element is receivable in the upper channel of a frame of the above described type with the rear panel of the frame received in the hook element, whereby the hanger-clip is secured adjacent the upper periphery of the frame. When the hanger-clip is secured in the frame in this manner, the rear plate portion extends downwardly adjacent the rear surface of the rigid panel of the frame. The hanger element of the clip is preferably of closed loop configuration and extends upwardly from a fold-line along the bottom edge of the plate portion whereby it is outwardly bendable along the fold-line to receive wall hanging members of various types, dimensions and configurations. In this connection, the hanger element preferably comprises a pair of spaced arms which extend from the fold-line and a cross member which extends between the ends of the arms so that the arms and the cross member cooperate to define a closed hanger loop. The cross member is preferably designed so that it is substantially parallel to the upper channel on the frame when the hanger-clip is received thereon and the inner edge of the cross member is preferably of saw tooth configuration. Accordingly, the hanger-clip is adjustably receivable on a wall hanging member with the wall hanging member received between a pair of the adjacent teeth on the cross member. The hanger-clip preferably further comprises at least one projection or dimple which extends rearwardly from the rear plate portion towards the hanger element to prevent the accidental interlocking or interconnection of the hanger elements of adjacent clips during the manufacture and storage of the clips prior to the assembly thereof onto frames, and particularly during the plating thereof.

It is, therefore, a primary object of the instant invention to provide an effective hanger-clip which is receivable in the upper channel of a picture frame and the like.

Another object of the instant invention is to provide a picture frame hanger-clip which is adjustable to accommodate wall hanging members of various types, configurations and dimensions.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 2:
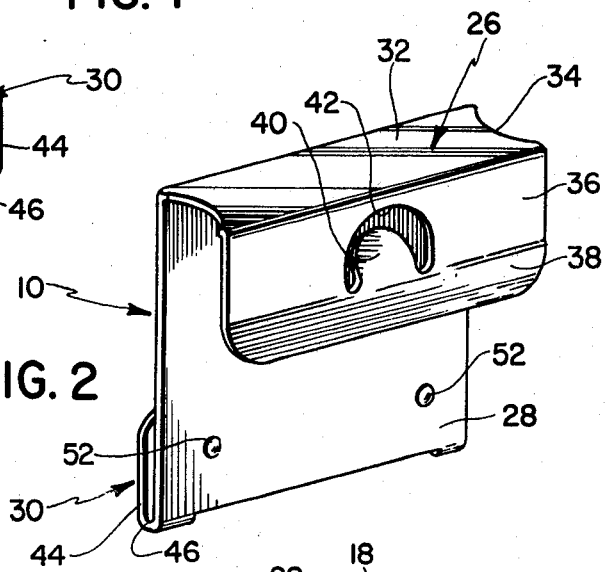
FIG. 2 is a front perspective view thereof.
Figure 3:
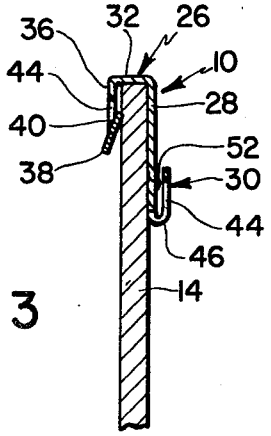
FIG. 3 is a sectional view of the hanger-clip in assembled relation with the rear panel of a frame.
Figure 4:
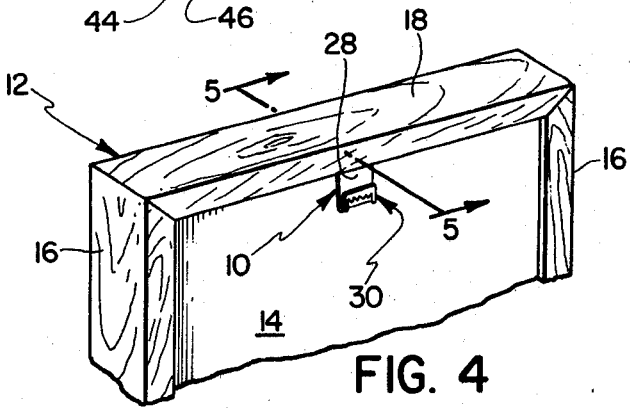
FIG. 4 is a fragmentary perspective view of the upper portion of a picture frame with the hanger-clip received thereon.
Figure 5:
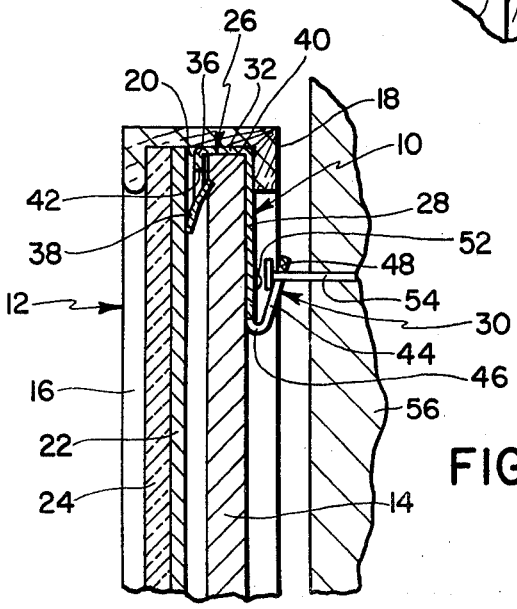
FIG. 5 is a sectional view taken along line 5—5 in FIG. 4.

Referring now to the drawing, the hanger-clip of the instant invention is illustrated in FIGS. 1–5 and generally indicated at 10. The hanger-clip 10 is receivable in a picture frame 12 of the type having a substantially rigid rear panel 14, as illustrated in FIGS. 4 and 5, with the rear panel 14 received in the clip 10.

The frame 12 is a conventional picture frame which comprises a pair of side frame elements 16, a top frame element 18 and a bottom frame element (not shown). The top and side frame elements 18 and 16, respectively, have inwardly facing channels therein which cooperate to receive the rear panel 14 as illustrated in FIGS. 4 and 5, the channel in the top frame element 18 being illustrated in FIG. 5 and indicated at 20. Also received in the channels in the elements 16 and 18 are a forwardly facing picture 22 and a transparent glass plate 24 which provides protection for the picture 22 in a well known manner.

The hanger-clip 10 comprises a hook element generally indicated at 26 having a downwardly extending rear plate portion 28 and a hanger element generally indicated at 30 which extends integrally upwardly from the lower end of the plate portion 28. The clip 10 is preferably made of steel and is preferably black oxidized or brass plated for enhanced protection and appearance. The hook element 26 comprises the rear plate portion 28, a top flange portion 32 which extends forwardly from the upper end of the plate portion 28 and has ends 34 which are of slightly arcuate configuration for aesthetic reasons, and a downwardly extending forward flange portion 36 which terminates in a slightly forwardly inclined lower lip 38. Integrally struck in the forward flange portion 36 is a tongue 40 which is defined by a crescent shaped opening 42 in the front flange portion 36 and which is inclined slightly rearwardly from the upper edge of the lip 38. The hanger member 30 comprises a pair of arms 44 which extend integrally upwardly from the lower end of the plate portion 28 along a fold-line 46 and a cross member 48 which extends between the upper ends of the arms 44. The arms 44 are disposed in spaced relation adjacent opposite sides of the plate portion 28 and cooperate with the cross member 48 to define a closed hanging loop adjacent the lower end of the hanger-clip 10. The inner periphery of the cross member 48 is defined by a plurality of adjacent downwardly extending saw teeth 50. Provided in the rear plate portion 28 extending rearwardly adjacent the opposite ends of the cross member 48 are dimples 52.

As illustrated in FIG. 5, the hanger-clip 10 is receivable on the upper edge of the rear panel 14 and thereafter the panel 14 with the clip 10 thereon is receivable in the channel 20 in the upper frame element 18. When the clip 10 is received in the channel 20 in this manner, the top flange portion 32 abuts the frame element 18 whereby the clip 10 can be used to support the frame 12. The lip 38 extends slightly forwardly to engage the rear surface of the picture 22, whereas the tongue 40 extends slightly rearwardly to engage the front surface of the panel 14. Accordingly, the panel 14 with the clip 10 thereon, the picture 22 and the glass 24 are snugly receivable in captured relation in the channel 20, as illustrated in FIG. 5. The hanger element 30 extends upwardly from the bottom end of the plate portion 28 and may be adjusted by bending it outwardly along the fold-line 46 to accommodate wall hanging members of various types, dimensions and configurations while nevertheless maintaining the frame 12 in closely spaced relation to a supporting surface. In addition, where for any reason it is necessary to have the hanger member 30 extend rearwardly an additional distance, the plate portion 28 may be rearwardly bent to the desired degree. As illustrated in FIG. 5, the hanger element 30 is received on a nail 54 which extends outwardly from a wall 56, the nail 54 being received between a pair of the adjacent teeth 50. By positioning the nail 54 between the appropriate teeth 50, the desired balance of the frame 12 can be effected whereby it will hang in a level disposition on the wall 56. If necessary, the clip 10 may be slidably moved along the top edge of panel 14 to achieve the desired balance.

Although the hanger-clip of the instant invention is primarily usable in connection with frames of the type illustrated in FIGS. 4 and 5, it is also usuable in connection with so-called "drop-in" frames, i.e., frames which have no peripheral channel.

Figure 1:
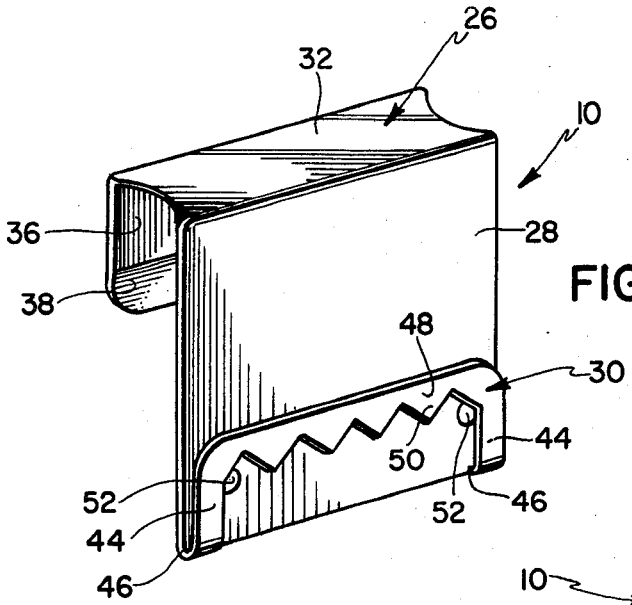
FIG. 1 is a rear perspective view of the hanger-clip of the instant invention.

The hanger-clip 20 also has several features which are significant from a manufacturing standpoint. Specifically, the clip 10 can be manufactured and shipped in a somewhat flatter configuration than the heretofore known hanger-clips, i.e., with the hanger portion 30 disposed adjacent the rear plate portion 28 as illustrated in FIGS. 1-3 so that the clip 10 occupies a minimal amount of space. Thereafter the clip 10 can be adjusted by the consumer by bending the hanger element 30 outwardly along the fold-line 46. Further, during the manufacture of the clips 10, the dimples 52 prevent the inadvertant interengagement of the hanger elements 30 of adjacent clips 10. This feature has particular significance when the clips 10 are plated since interconnection of the clips during plating operations prevents complete and effective plating of the parts.

It is seen, therefore, that the instant invention provides an effective hanger-clip for picture frames and the like. The hanger-clip 10 can easily be installed on the frame 12 by a consumer simply by positioning the clip 10 on the panel 14 and assembling the panel 14 in the frame 12. Thereafter the hook portion 30 may be adjusted by bending it outwardly along the fold-line 46 to accommodate particular wall hanging members. Hence it is seen that the hanger-clip of the instant invention provides a significant advancement in the art which has substantial commercial merit.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A hanger-clip for a picture frame and the like of the type having a peripheral frame and a substantially rigid rear panel mounted therein having an upper peripheral portion abutting the upper portion of said frame, said hanger-clip comprising:

a. a hook element having a downwardly extending rear plate portion, said hook element being slidably receivable on said panel upper peripheral portion with said plate portion extending downwardly adjacent the rear surface of said panel;

b. a hanger element which extends integrally upwardly from the lower end of said rear plate portion for mounting said hanger-clip on a wall hanging member and the like comprising a pair of spaced arms which are attached to the lower end of said plate portion along a fold line and extend integrally upwardly therefrom along the rear side of said plate portion in closely spaced substantially parallei relation thereto, and an upper cross member which extends between the upper ends of said arms adjacent said plate portion so that said hanger element is positioned in a substantially flat disposition on the rear side of said plate portion, said arms being outwardly bendable along said fold line to position said hanger element in various desired angular positions relative to said plate portion for adjusting said clip to receive wall hanging members of various types; and c. a pair of dimples on said plate portion which extend rearwardly terminating adjacent the terminal ends of said arms where they are connected to said cross member to prevent the interengagement of said hanger element with a hanger element of another of said hanger clips.

* * * * *